United States Patent [19]

Fukuyama et al.

[11] Patent Number: 5,075,023

[45] Date of Patent: Dec. 24, 1991

[54] ELECTROVISCOUS FLUID

[75] Inventors: Yoshiki Fukuyama, Kodaira; Yuichi Ishino, Fuchu; Toshiyuki Osaki, Higashimurayama; Takayuki Maruyama, Kodaira; Tasuku Saito, Tokorozawa, all of Japan

[73] Assignee: Bridgestone Corporation, Tokyo, Japan

[21] Appl. No.: 443,370

[22] Filed: Nov. 30, 1989

[30] Foreign Application Priority Data

Dec. 17, 1988 [JP] Japan ..... 63-317624

[51] Int. Cl.[5] ..... C09K 3/00

[52] U.S. Cl. ..... 252/74; 252/75; 252/78.3; 252/572

[58] Field of Search ..... 252/74, 75, 78.3, 572, 252/573

[56] References Cited

U.S. PATENT DOCUMENTS

| | | | |
|---|---|---|---|
| 3,047,507 | 7/1962 | Winslow | 252/75 |
| 3,427,247 | 2/1969 | Peck | 252/75 |
| 4,416,790 | 11/1983 | Schürmann et al. | 252/62 |
| 4,668,417 | 5/1987 | Goosens et al. | 252/77 |
| 4,702,855 | 10/1987 | Goosens et al. | 252/74 |

FOREIGN PATENT DOCUMENTS 1-253110 10/1989 Japan .

1-278599 11/1989 Japan .

*Primary Examiner*—Paul Lieberman
*Assistant Examiner*—Christine A. Skane
*Attorney, Agent, or Firm*—Cushman, Darby & Cushman

[57] ABSTRACT

The electroviscous fluid is a suspension composed of a finely divided dielectric solid dispersed in an electrically nonconductive oil. Viscosity of the fluid increases swiftly and reversibly under an influence of electric field applied thereto and the fluid turns to a state of plastic or solid when the influence is sufficiently strong.

The electroviscous fluid of the present invention comprises (A) 1–60% by weight of a dispersed phase composed of hygroscopic inorganic particles having an average particle size of 0.01–20 micrometer and regulated to a water content of 0.1–10% by weight and adsorbing a high boiling point liquid polar compound, and (B) 99–40% by weight of a liquid phase of an electric insulating oil having a viscosity 0.65–500 centistokes at room temperature.

The electroviscous fluid exhibits an excellent electroviscous effect for a long period of time with a low electric power consumption together with a quick response at the application and cancellation of an electric potential difference.

6 Claims, 1 Drawing Sheet

ELECTROVISCOUS FLUID

FIELD OF THE INVENTION

The present invention relates to an electroviscous fluid which increases its viscosity when an electric potential difference is applied thereto.

DESCRIPTION OF THE PRIOR ART

The electroviscous fluid is a suspension composed of a finely divided hydrophilic solid dispersed in an electrically nonconductive oil. The viscosity of the fluid increases swiftly and reversibly under influence of an electric field applied thereto and the fluid turns to a state of plastic or solid when the influence of the electric field is sufficiently strong.

The electric field to be applied for changing the viscosity of the fluid can be not only that of a direct current but also that of an alternating current, and the electric power requirement is very small to make it possible to give a wide range of viscosity variation from liquid state to almost solid state with a small consumption of electric power.

The electroviscous fluid has been studied with an expectation that it can be a system component to control such apparatus or parts as a crutch, a hydraulic valve, a shock absorber, a vibrator, a vibration isolating rubber, an actuator, a robot arm, a damper, for example.

U.S. Pat. No. 3,047,507 proposed various kinds of materials as the dispersed phase of an electroviscous fluid, and silica gel was mentioned as a preferable material among them. As the liquid medium for dispersion, an electrically nonconductive oil such as silicone oil was used. However, the electroviscous fluid using silica gel as the dispersed phase showed small electroviscous effect which is unsatisfactory for practical usages.

Japanese Patent Provisional Publication Tokkaisho 62-95397 proposed electroviscous fluids using aluminosilicates having Al/Si atomic ratio of 0.15–0.80 at the surface and water content of 1–25% by weight as the dispersed phase, and mentioned electroviscous fluids using various kinds of crystalline zeolite as the dispersed phase in its examples. The crystalline zeolite of such composition is hydrophilic and contains much water in its crystal. Accordingly, the electroviscous fluid using such crystalline zeolite as the dispersed phase shows an excessive electric conductivity to result in a disadvantage of much electric power consumption.

In order solve the problem caused by the contained water, U.S. Pat. No. 4,744,914 proposed an electroviscous fluid using crystalline zeolite having the following general formula and containing substantially no adsorbed water as the dispersed phase;

$$M_{(x/n)}[(AlO_2)_x(SiO_2)_y]\cdot wH_2O,$$

wherein, M is a hydrogen ion, a metallic cation or a mixture of metallic cations having an average electron value n; x and y are integers; w is an indefinite number and the value of y/x is about 1 to about 5.

In order to eliminate the adsorbed water, U.S. Pat. No. 4,744,914 proposed a treatment wherein the electric insulating oil and the crystalline zeolite particles were treated under a temperature higher than temperatures expected to be employed at the usage of the electroviscous fluid for enough time required to attain necessary degree of degassing and elimination of water. However, by the dehydration treatment of the hydrophilic crystalline zeolite which contains much water originally, the surface of the zeolite becomes very active and tends to cause secondary coagulation.

Mechanism of the electroviscous effect is that the application of an electric potential difference to the electroviscous fluid induces formation of bridges among the particles dispersed therein due to polarization and elevation of viscosity of the fluid.

When the second coagulation of the dispersed particles accompanies at the same time, rearrangement of the dispersed particles occurs and takes a few minutes to reach a stabilized value of viscosity when an electric potential difference is applied thereto and a rapid response required to the electroviscous fluid cannot be expected. This phenomenon is conspicuous at low temperature zone where the movement of ions is slow, though it is not a serious problem at high temperature zone where the movement of ions is rapid.

Further, when such electroviscous fluid is allowed to stand in the atmosphere, the electroviscous fluid cannot maintain a stable electroviscous effect, because the crystalline zeolite particles composing the dispersed phase re-adsorb moisture from the atmosphere through the electric insulating oil.

SUMMARY OF THE INVENTION

The object of the present invention is to provide an electroviscous fluid which shows a quick responses at the application and cancellation of an electric potential difference thereto, can exhibit a greater electroviscous effect with less electric power consumption and maintain the electroviscous effect stably for a long period of time.

DETAILED DESCRIPTION OF THE PREFERRED EMBODIMENTS

Figure 1A:
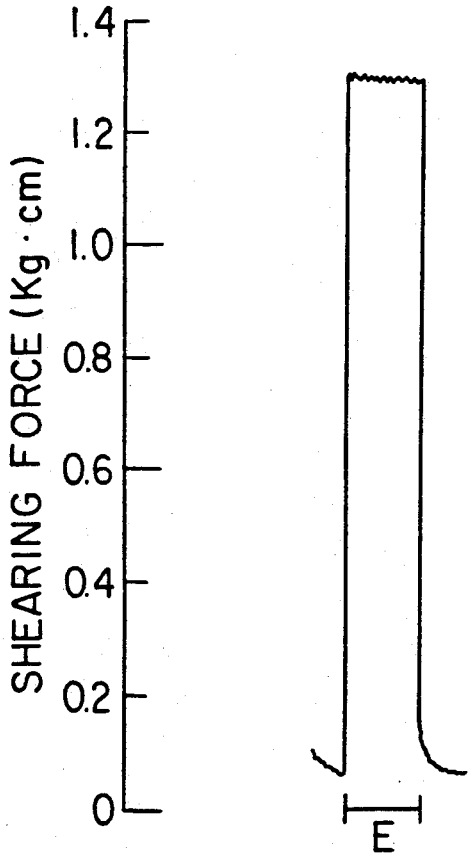
FIG. 1A is a graph showing the response behavior of the electroviscous fluid of Example 1 and FIG. 1B is a graph showing the response behavior of the electroviscous fluid of Comparative Example 3 at the application and cancellation of electric potential difference of 2 KV/mm at 25° C.

The electroviscous fluid of the present invention comprises; (A) 1–60% by weight of a dispersed phase composed of hygroscopic inorganic particles having an average particle size of 0.01–20 micrometer and regulated to a water content of 0.1–10% by weight and adsorbing a high boiling point liquid polar compound, and (B) 99–40% by weight of a liquid phase of an electric insulating oil having a viscosity of 0.65–500 centistokes at room temperature.

The hygroscopic inorganic particles preferably used in the present invention include crystalline zeolite and silica gel. The water content of them must be regulated to 0.1–10%, preferably to 0.5–5% by weight by drying. When the water content is smaller than 0.1% by weight, the electroviscous effect becomes smaller due to insufficient water content. When the water content is larger than 10% by weight, electric power consumption becomes larger due to large electric conductivity caused by water.

The particle size suitable for the dispersed phase of the electroviscous fluid is in the range of 0.01–20 micrometer, preferably in the range of 0.3–5 micrometer. When the size is smaller than 0.01 micrometer, initial viscosity of the fluid under no application of electric field becomes extremely large and the change in viscosity caused by the electroviscous effect is small. When the size is over 20 micrometer, the dispersed phase can not be held sufficiently stable in the liquid.

As the high boiling point liquid polar compound to be adsorbed by the hygroscopic inorganic particles after they were regulated to water content of 0.1–10% by weight, alcohols such as 1,2-ethanediol, 1,2-propanediol, 1,3-propanediol, 1,4-butanediol, glycerine; esters such as γ-butyrolactone, ethylene carbonate, propylene carbonate; nitrogen-containing compounds such as nitrobenzene, succinonitrile, formamide, N-methylformamide, N,N-dimethylformamide, acetamide, N-methylacetamide, N,N-dimethylacetamide; and sulfur-containing compounds such as dimethylsulfoxyd, sulfolan are mentioned. Another high boiling point liquid polar compound which did not mentioned above, such as diethylene glycol, can also be used.

When the boiling point of the liquid polar compound is low, evaporation of the liquid polar compound becomes larger and stable electroviscous effect for a long period of time cannot be expected. The preferable boiling point of the liquid polar compound is 150° C. or more, desirably 200° C. or more.

The preferable quantity of the high boiling point liquid polar compound to be adsorbed by the hygroscopic inorganic particles is 1–25% by weight.

The role of the high boiling point liquid polar compound is thought that it will heighten the degree of dissociation of water which has been adsorbed at the surface of dispersed particles and promote the polarization to ions when an electric potential difference is applied thereto. Thus the electroviscous effect is increased and the responding behavior is improved. Accordingly, if the polarity of the liquid compound is smaller, the effect will become smaller. The dielectric constant of the liquid compound is preferably 30 or more, more preferably 50 or more.

As the electric insulating oil to constitute the liquid phase of an electroviscous fluid, hydrocarbon oils, ester oils, aromatic oils, halogenated hydrocarbon oils such as perfluoropolyether and polytrifluoromonochloroethylene, phosphazene oils and silicone oils are mentioned. They may be used alone or in a combination of more than two kinds. Among these oils, such silicone oils as polydimethylsiloxane, polymethylphenylsiloxane and polymethyltrifluropropylsiloxane are preferred, since they can be used in direct contact with materials such as rubber and various kinds of polymers.

The desirable viscosity of the electric insulating oil is in the range of 0.65–500 centistokes (cSt), preferably in the range of 5–200 cSt, and more preferably in the range of 10–50 cSt at 25° C. When the viscosity of the oil is too small, stability of the liquid phase becomes inferior due to an increased content of volatile components, and a too high viscosity of the oil brings about an heightened initial viscosity under no application of electric field to result in a decreased changing range of viscosity by the electroviscous effect. When an electric insulating oil having an appropriate low viscosity is employed as the liquid phase, the liquid phase can suspend a dispersed phase efficiently.

With regard to the ratio of the dispersed phase to the liquid phase constituting the electroviscous fluid according to the present invention, the content of the dispersed phase composed of the aforementioned hygroscopic inorganic particles is 1–60% by weight, preferably 20–50% by weight, and the content of the liquid phase composed of the aforementioned electric insulating oils is 99–40% by weight, preferably 80–50% by weight. When the dispersed phase is less than 1% by weight, the electroviscous effect is too small, and when the content is over 60% by weight, an extremely large initial viscosity under no application of electric field appears.

It may be possible to incorporate or compound other dispersed phase and additives including surface active agents, dispersing agents, antioxidant and stabilizing agent into the electroviscous fluid of the present invention, so far as being within a range of not deteriorating the effects of the present invention.

The present invention will be illustrated with Examples hereinafter.

EXAMPLE 1

Na-Y type crystalline zeolite particles (manufactured by Catalysts & Chemicals Industries Co.) having an average particle size of 1 micrometer and water content of 20% by weight were dried at 275° C. for 5 hours under vacuum, then cooled for 15 hours under vacuum to room temperature. Then the dried particles were brought back to normal pressure and propylene carbonate (boiling point: 242° C.; dielectric constant: 69) was introduced immediately. Then the dried particles were stood on for 5 hours at 100° C. under vacuum so as to adsorb the propylene carbonate thoroughly to reach the adsorption ratio of 20% by weight. The water content of the zeolite particles at that time was 1.1% by weight. 40 parts by weight of the zeolite particles were dispersed in a liquid phase component being 60 parts by weight of a silicone oil (Toshiba-Silicone Co.: TSF 451-20®) having 20 cSt viscosity at 25° C. to prepare an electroviscous fluid in a suspension form.

COMPARATIVE EXAMPLE 1

A silica-gel (Nippon Silica Co.: NIPSIL VN-3®) was treated to make the water content to 6% by weight, and 13 parts by weight thereof were dispersed in a liquid phase component being 87 parts by weight of a silicone oil (Toshiba-Silicone Co.: TSF 451-20®) having 20 cSt viscosity at 25° C. to prepare an electroviscous fluid in a suspension form.

COMPARATIVE EXAMPLE 2

30 parts by weight of Na-Y type crystalline zeolite particles (manufactured by Catalysts & Chemicals Industries Co.) having an average particle size of 1 micrometer and water content of 20% by weight as used in Example 1 were dispersed in a liquid phase component being 70 parts by weight of a silicone oil (Toshiba-Silicone Co.: TSF 451-20®) having 20 cSt viscosity at 25° C. to prepare an electroviscous fluid in a suspension form.

COMPARATIVE EXAMPLE 3

The same Na-Y type crystalline zeolite particles (manufactured by Catalysts & Chemicals Industries Co.) having an average particle size of 1 micrometer [and water content of 20% by weight] as used in Comparative Example 2 were dried at 275° C. for 5 hours under vacuum, then cooled for 15 hours under vacuum to room temperature. The water content of the zeolite particles at that time was 1.3% by weight. 30 parts by weight of the dried particles were dispersed in a liquid phase component being 70 parts by weight of a silicone oil (Toshiba-Silicone Co.: TSF 451-20 ®) having 20 cSt viscosity at 25° C. to prepare an electroviscous fluid in a suspension form.

Each of the electroviscous fluids prepared in Example 1 and Comparative Examples 1-3 were subjected to measurements of the electroviscous effect. The results are shown in Table 1. As to the electroviscous fluids of Example 1 and Comparative Example 3, values measured after stood on for 30 day in the atmosphere were also shown in Table 1.

The electroviscous effect was measured with a double-cylinder type rotary viscometer to which a direct current was applied with an electric potential difference of 0-2 KV/mm between the outer and inner cylinder, and the effect was evaluated with shearing force under the same shearing speed (366 sec.$^{-1}$) at 25°, together with measurement of electric current density between the inner and outer cylinders. (radius of inner cylinder: 34 mm, radius of outer cylinder: 36 mm, height of inner cylinder: 20 mm).

In Table 1, To is the shearing force under no application of electric potential difference, T is the shearing force under application of electric potential difference of 2 KV/mm, T-To is the difference of T and To and the current density is the value under application of electric potential difference of 2 KV/mm.

The value of T-To indicates the magnitude of electroviscous effect of the fluid. That is, a fluid showing a larger T-To in Table 1 exhibits a larger electroviscous effect. And the value of the current density ($\mu A/cm^2$) concerns an electric power required to apply the electric potential difference (2 KV/mm).

TABLE 1

| | water content (wt. %) | To (g · cm) | T (g · cm) | T-To (g · cm) | Current Density ($\mu A/cm^2$) |
|---|---|---|---|---|---|
| Example 1 | 1.1 | 83 | 1290 | 1207 | 9 |
| after 30 days | 1.2 | 72 | 1284 | 1212 | 14 |
| Comp. Ex. 1 | 6.0 | 255 | 540 | 285 | 21 |
| Comp. Ex. 2 | 20 | 47 | 635 | 588 | over 1000 |
| Comp. Ex. 3 | 1.3 | 121 | 1120 | 999 | 24 |
| after 30 days | 4.4 | 79 | 836 | 757 | 7 |

To: Shearing force under no application of electric potential difference
T: Shearing force under application of electric potential difference (2KV/mm)

The electroviscous fluid of Examples 1 showed a large electroviscous effect with little electric power consumption. Further, after 30 days of standing, the water content of the fluid was almost equal to the initial value and all of the values of To (shearing force under no application of electric potential difference), T (shearing force under application of electric potential difference of 2 KV/mm) and T-To were kept almost equal to the initial values, indicating a stable electroviscous effect.

On the other hand, the electroviscous fluid of Comparative Example 1 using silica gel as the dispersed phase showed an inferior electroviscous effect though the electric power consumption was small. The electroviscous fluids of Comparative Example 2 using Na-Y type crystalline zeolite particles containing much water as the dispersed phase showed an extremely large electric power consumption though the electroviscous effect was large. The electroviscous fluids of Comparative Example 3, which used the same crystalline zeolite particles as the dispersed phase after drying, showed a larger electroviscous effect with less electric power consumption compared to that of Comparative Example 2. However, after 30 days of standing, the water content of the fluid became three times of the initial value and all of the values of To (shearing force under no application of electric potential difference), T (shearing force under application of electric potential difference of 2 KV/mm) and T-To decreased showing an unstable electroviscous effect.

Figure 1B:
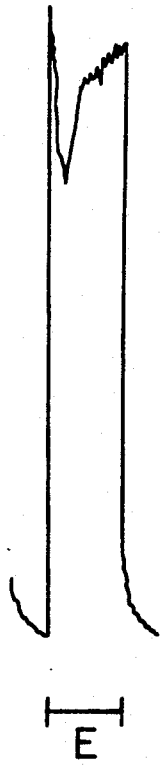

Further, as can be observed in attached FIG. 1B, the electroviscous fluid of Comparative Example 3 showed unstable behavior at the application of the electric potential difference E (2 KV/mm) and delayed response at the cancellation of the electric potential difference. The reason of this phenomenon is supposed to be caused by secondary coagulation of active zeolite particles originated by dehydration treatment of the particles.

On the other hand, as can be observed in FIG. 1A, the electroviscous fluid of Example 1 showed a rapid and sharp response at the application and cancellation of electric potential difference (2 KV/mm).

In FIG. 1A and FIG. 1B, E in abscissa shows the period of the application of electric field 2 KV/mm at 25° C. and ordinate shows the shearing force (Kg·cm) observed.

What is claimed is:

1. An electroviscous fluid comprising:
(A) 20-60% by weight of a dispersed phase composed of crystalline zeolite particles having an average particle size of 0.01-20 micrometer and regulated to a water content of 0.1-10% by weight and 1-25% by weight absorbed ethylene carbonate, propylene carbonate or mixtures thereof, and
(B) 80-40% by weight of a liquid phase of an electric insulating oil having a viscosity of 0.65-500 centistokes at room temperature.

2. An electroviscous fluid according to claim 1 wherein the electric insulating oil is a silicone oil.

3. An electroviscous fluid according to claim 1 wherein the water content of the crystalline zeolite particles is regulated to 0.5-5% by weight.

4. An electroviscous fluid according to claim 1 wherein the average particle size of the crystalline zeolite particles is 0.3-5 micrometer.

5. An electroviscous fluid according to claim 4 wherein the silicone oil has a viscosity of 5-50 centistokes at room temperature.

6. An electroviscous fluid according to claim 1 wherein the dispersed phase is 20-50% by weight and the liquid phase is 50-80% by weight.

* * * * *